United States Patent [19]

Mizukura et al.

[11] 4,407,938

[45] Oct. 4, 1983

[54] PHOTOGRAPHIC ELEMENT WITH LACTONE POLYMER

[75] Inventors: Noboru Mizukura, Tsukui; Mikio Koyama, Tokorosawa, both of Japan

[73] Assignee: Konishiroku Photo Ind. Co., Ltd., Japan

[21] Appl. No.: 369,362

[22] Filed: Apr. 19, 1982

[30] Foreign Application Priority Data

Apr. 29, 1981 [JP] Japan ..... 56-65445

[51] Int. Cl.[3] ..... G03C 1/40; G03C 1/48; G03C 1/78

[52] U.S. Cl. ..... 430/533; 430/215; 430/536

[58] Field of Search ..... 430/215, 216, 533, 536

[56] References Cited

U.S. PATENT DOCUMENTS 4,229,516 10/1980 Abel ..... 430/215

FOREIGN PATENT DOCUMENTS 9795 4/1980 European Pat Off. .
55-54341 4/1980 Japan .

OTHER PUBLICATIONS

"Neutralizing Materials in Photographic Elements", *Research Disclosure*, No. 12331, 7/74, pp. 22–24.

*Primary Examiner*—Richard L. Schilling
*Attorney, Agent, or Firm*—Finnegan, Henderson, Farabow, Garrett & Dunner

[57] ABSTRACT

A photographic element comprising a support having thereof at least one silver halide emulsion layer and at least one temporary barrier layer, said temporary barrier layer comprising a mixture of a lactone polymer with repetitive units represented by the formula (I):

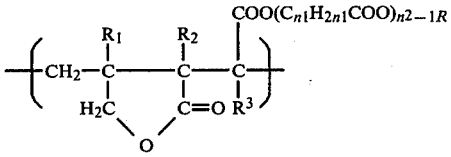

Formula (I)

and a vinylidene chloride terpolymer represented by the formula (II):

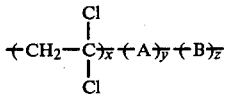

Formula (II)

wherein R is a hydrogen atom, an alkyl or an aralkyl group; $R^1$, $R^2$ and $R^3$ each is a hydrogen atom or a methyl group; $n^1$ is an integer of from 1 to 5, while $n^2$ is an integer of 1 or 2; A is a monomer unit of a copolymerizable ethylenically unsaturated acid or of the salt thereof, while B is a copolymerizable ethylenically unsaturated monomer unit; x represents from 50 to 99.5% by weight, y represents from 0.5 to 44.5% by weight, and z represents from 0 to 49.5% by weight.

8 Claims, No Drawings

PHOTOGRAPHIC ELEMENT WITH LACTONE POLYMER

The present invention relates to a photographic element having a temporary barrier layer.

There has been known in the normal color photographic and color diffusion transfer processes the incorporation of a temporary barrier layer into between processing composition permeable layers of a photographic element. In a conventional color photographic element, for example, a temporary barrier layer as an interlayer is employed between two silver halide emulsion layers to reduce the influence by one emulsion layer upon the other.

And in the diffusion transfer process, particularly in the color diffusion transfer process, it has been known that a neutralizing layer is used in a photographic element to stop the developing action and/or diffusion transfer action and to stabilize the formed dye image, and further in order to timely control the lowering of pH by the neutralizing layer, a temporary barrier layer as a timing layer is used together with the neutralizing layer.

The color diffusion transfer process is in many cases utilized in the so-called instant photography, whose processing may be effected at various temperatures. If the processing is effected at a temperature considerably lower than room temperature, the developing reaction becomes significantly inactive and the neutralizing layer lowers the pH value prior to the completion of desired development thereby to lower the maximum density or to increase the minimum density, thus hindering the formation of any satisfactory dye image. While if the processing takes place at a temperature considerably higher than room temperature, the lowering of the pH value is delayed, leading to an overdevelopment of the silver halide emulsion, thus also hindering the formation of any satisfactory dye image.

In order to solve this disadvantage, the use of a timing layer whose alkali permeability sufficiently depends on the change in temperature, i.e., a timing layer having a large alkali permeability at a higher temperature while having a small alkali permeability at a lower temperature enables the formation of a satisfactory dye image over a wide temperature range; this has been disclosed in, e.g., Japanese Patent Publication Open to Public Inspection (hereinafter referred to as Japanese Patent O.P.I. Publication) No. 72622/1978 and U.S. Pat. No. 4,061,496.

However, those conventionally known timing layers had such disadvantages that the dependence thereof upon temperatures is insufficient and the alkali permeability of the timing layer changes with time.

In addition, those conventionally known timing layers are dull in the lowering of the pH, causing the decrease in the maximum density, the increase in the minimum density or the decrease of the transfer speed, thus hindering the formation of any satisfactory dye image. In connection with this, for example, Japanese Patent O.P.I. Publications Nos. 54341/1980 and EP-9795 describe a barrier layer containing a mixture of a lactone polymer with vinylidene chloride terpolymer, but both polymers are disadvantageous in respect that their compatibility is so unsatisfactory as to bring about a devitrification of the barrier layer.

It is an object of the present invention to provide a photographic element which is free from such disadvantages as described above and which has a satisfactory temporary barrier layer improved in the alkali permeability and in the dependence upon temperatures and is capable of forming an excellent dye image, and it is another object of the present invention to provide a photographic element having a temporary barrier layer which is improved in the devitrification as well as in the prevention of the sensitivity deterioration.

SUMMARY OF THE INVENTION

As a result of having devoted ourselves to studies on the above-described objects, we have found that said objects can be accomplished by a photographic element comprising on the support thereof at least one silver halide emulsion layer and at least one temporary barrier layer, said temporary barrier layer comprising a mixture of a lactone polymer with repetitive units represented by the formula (I);

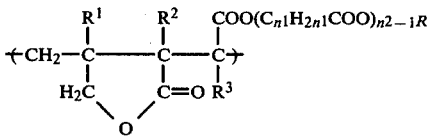

Formula (I)

and a vinylidene chloride terpolymer represented by the formula (II);

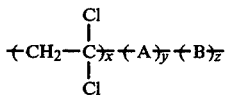

Formula (II)

wherein R is a hydrogen atom, an alkyl or an aralkyl group; $R^1$, $R^2$ and $R^3$ each is a hydrogen atom or a methyl group; $n^1$ is an integer of from 1 to 5, while $n^2$ is an integer of 1 or 2; A is a monomer unit of a copolymerizable ethylenically unsaturated acid or of the salt thereof, while B is a copolymerizable ethylenically unsaturated monomer unit; x represents from 50 to 99.5% by weight, y represents from 0.5 to 44.5% by weight, and z represents from zero to 49.5% by weight.

DETAILED DESCRIPTION OF THE INVENTION

In the present invention, since the temporary barrier layer of a photographic element is formed by the use of a mixture of novel polymers having the above formulas, the use of such novel polymers has enabled the temporary barrier layer to be improved in the devitrification and alkali permeability thereof and to be excellent in the dependence thereof upon temperatures and thus has enabled the photographic element to form a better dye image quality than those conventional ones.

The present invention is illustrated in further detail below:

The alkyl group represented by the R in Formula (I) includes an alkyl group having from 1 to 12 carbon atoms, but preferred alkyl group are one having from 3 to 5 carbon atoms and may also be one having arbitrary substituents unless it adversely affects the solubility of the obtained lactone polymer. The aralkyl group in the formula is desirable to be one having an alkyl group from 1 to 4 carbon atoms. And the most desired substituent represented by the $R^1$, $R^2$ and $R^3$ is methyl.

The A in Formula (II) include preferably those having at least one carboxyl, sulfo or phosphono group or the salt thereof. Preferred among those having carboxyl or sulfo or the salt thereof are those having one or two carboxyl groups or sulfo groups or the salts thereof including, e.g., acrylic acid, methacrylic acid, itaconic acid, monomethyl itaconate, monobutyl itaconate, monomethyl maleate, monobutyl maleate, styrene sulfonate, acryloyl-oxypropyl sulfonate, and 2-acrylamide-2-methyl-ethane sulfonate, and alkali metal salts or ammonium salts of these acids. Among them the most preferred are acrylic acid and itaconic acid.

Preferred among those monomers having a phosphono group or the salt thereof among those monomers constituting units represented by the A are those having one phosphono group or the salt thereof including, e.g., 2-acryloyloxyethyl phosphate, 2-acryloyloxyethoxy-ethyl phosphate, 2-methacryloyloxy-ethyl phosphate.

Further, those copolymerizable ethylenically unsaturated monomers represented by the B in Formula (II) include preferably ethylenically unsaturated nitriles, styrenes, ethylenically unsaturated acid esters, ethylenically unsaturated acid amides, vinyl heterocyclic compounds, and the like.

Examples of the above ethylenically unsaturated nitriles include acrylonitrile, methacrylonitrile, α-chloroacrylonitrile, vinylidene cyanide, and the like. Examples of the styrenes include styrene, p-methyl styrene, α-methyl styrene, p-chlorostyrene, m-methyl styrene, 2,5-dimethyl styrene, and the like. As ethylenically unsaturated acid esters, ethylenically unsaturated carboxylic esters are preferred, examples of which include methyl acrylate, ethyl acrylate, n-butyl acrylate, 2-hydroxy-ethyl acrylate, 2-hydroxy-propyl acrylate, benzyl acrylate, phenyl acrylate, methyl methacrylate, ethyl methacrylate, n-butyl methacrylate, 2-hydroxy-ethyl methacrylate, phenyl methacrylate, and the like.

And the foregoing ethylenically unsaturated acid amides include acrylamides, methacrylamides, and the like, and those acrylamides include, e.g., acrylamide, diacetone acrylamide, methylol acrylamide, methyl acrylamide.

Those methacrylamides include, e.g., methacrylamide, benzyl methacrylamide, and the like.

Further, the foregoing vinyl heterocyclic compounds include, e.g., N-vinyl pyrolidone, N-vinyl imidazole, vinyl pyridines (such as 4-vinyl pyridine, 2-vinyl pyridine, and the like).

Preferred ones among those monomers suitable for constituting units represented by the B include copolymerizable ethylenically unsaturated nitriles (particularly acrylonitrile, methacrylonitrile), styrenes (particularly styrene), acrylic acid esters (particularly those lower alkyl esters having from 1 to 4 carbon atoms, such as ethyl acrylate, 2-hydroxyethyl acrylate, n-butyl acrylate), methacrylic esters (particularly those lower alkyl esters having from 1 to 4 carbon atoms, such as methyl methacrylate).

In those copolymers having Formula (II), percent by weight x of vinylidene chloride monomers is preferably from 50 to 90% by weight, while percent by weight y of unit A is preferably from 0.5 to 20% by weight, and more preferably from 2 to 15% by weight. And percent by weight z of unit B is from zero to 49.5% by weight. Those monomers for constituting units A and B are allowed to be not less than two kinds for each unit.

The following are preferred examples of repetitive units of those lactone polymers having Formula (I), but the present invention is not limited thereto:

Exemplified Compounds:

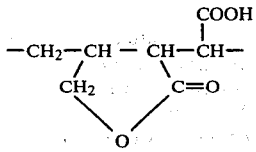
(1)

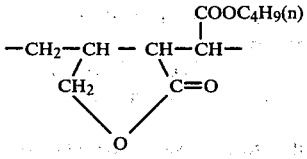
(2)

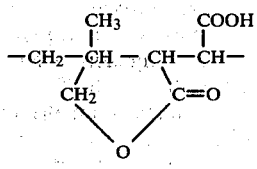
(3)

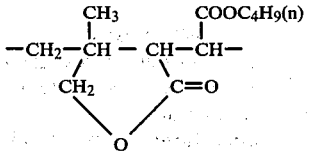
(4)

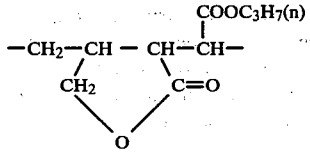
(5)

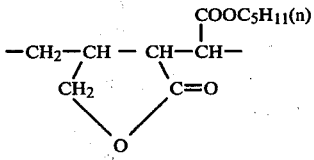
(6)

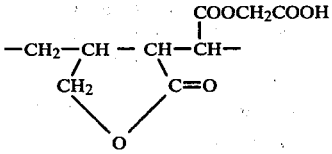
(7)

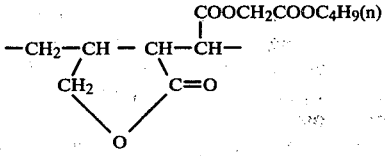
(8)

Preferred examples of those vinylidene chloride terpolymers having Formula (II) are then enumerated below, but the present invention is not limited thereto:

| Exemplified Compounds: | |
|---|---|
| (1) Vinylidene chloride - acrylic acid - acrylonitrile copolymer | (percent by weight 75:6:19) |
| (2) Vinylidene chloride - itaconic acid - methyl methacrylate copolymer | (percent by weight 83:2:15) |

-continued

| Exemplified Compounds: | |
|---|---|
| (3) Vinylidene chloride - acrylic acid - acrylonitrile copolymer | (percent by weight 80:6:14) |
| (4) Vinylidene chloride - itaconic acid - ethyl acrylate copolymer | (percent by weight 83:2:15) |
| (5) Vinylidene chloride - itaconic acid - methyl acrylate copolymer | (percent by weight 55:6:39) |
| (6) Vinylidene chloride - acrylic acid - methyl acrylate copolymer | (percent by weight 60:5:35) |
| (7) Vinylidene chloride - acrylic acid - acrylonitrile copolymer | (percent by weight 75:8:17) |
| (8) Vinylidene chloride - acrylic acid - acrylonitrile copolymer | (percent by weight 75:7:18) |
| (9) Vinylidene chloride - 2-methacryloyloxy-ethyl phosphate - butyl acrylate - methacrylonitrile copolymer | (percent by weight 72:4:12:12) |
| (10) Vinylidene chloride - 2-acryloyloxy-ethyl phosphate - butyl acrylate copolymer | (percent by weight 75:10:15) |

The lactone polymer having a repetitive unit as shown in the foregoing examples is desirable to have from about 0.25 to about 5.0 milli equivalents of an acid in 1 g of the polymer. The determination of the acid in the polymer is to be made in the manner of the titration of a sample dissolved in a mixture solution of acetone with water (ratio of 1:1) by 0.1 N sodium hydroxide with phenolphthalein as an indicator.

In a lactone polymer unit having Formula (I), the synthesis of the lactone polymer wherein $n^2$ is 1 may be obtained generally in the manner that either unsaturated $\alpha,\beta$-dicarboxylic acid or the acid anhydride thereof and an aryl alcohol or methacryl alcohol or an organic acid ester thereof are copolymerized to produce a copolymer, and the copolymer is then hydrolyzed with an acid as a catalyst thereby to be lactonized.

Since the lactone obtained by the above lactonization reaction has a free carboxyl group such as in Exemplified Compound (1) or (3), in the case of synthesizing such a lactone polymer having a carboxylic acid ester as in Exemplified Compound (2), (4), (5) or (6), for example, butanol or the like is used in the above lactonization reaction, whereby the above-described carboxylic ester-having lactone polymer can be obtained.

In a lactone polymer having Formula (I), the synthesis of the lactone wherein $n^2$ is 2, may be obtained generally in the manner that $\alpha,\beta$-dicarboxylic acid or the acid anhydride thereof and an allyl alcohol or methallyl alcohol or an organic ester thereof are copolymerized to produce a copolymer, and the copolymer is hydrolyzed in the presence of oxycarboxylic acid with an acid as a catalyst thereby to be lactonized.

Since the lactone obtained by the above lactonization reaction has a free carboxyl group such as in Exemplified Compound (7), in the case of synthesizing a lactone polymer having the carboxylic acid ester shown in Exemplified Compound (8), for example, butanol or the like is used in the above lactonization reaction, whereby the above carboxylic acid ester-having lactone polymer may be obtained.

In addition, as the acid used as a catalyst in the above lactonization reaction, an inorganic acid such as sulfuric acid is desirable, and by changing in the quantity of water contained in the reaction system, the acid content of the polymer may be adjusted. The $\alpha,\beta$-unsaturated dicarboxylic acid used in the above synthesis includes maleic acid, itaconic acid, citraconic acid, dimethylmaleic acid, anhydrides of these acids, and alkyl esters of these acids having from 1 to 4 carbon atoms. Among them maleic acid or the acid anhydride thereof is preferred. And typical allyl alcohols, methallyl alcohols and organic acid esters thereof include allyl alcohols, methallyl alcohols, allyl acetates, methallyl acetates, allyl propionates, methallyl propionates, allyl butyrates, and allyl benzoates. Among these, allyl acetates and methallyl alcohols are preferred.

Synthesis examples of lactone polymers of the present invention are described below:

SYNTHESIS EXAMPLE 1

(Copolymerization of an allyl acetate and maleic anhydride)

49.6 g of an allyl acetate (0.5 mol) and 49.0 g of maleic anhydride (0.5 mol) were dissolved in 300 ml of dichloroethane. A slight amount of insoluble matter remaining in the solution was filtered off, and the filtrate was put in a 1 l-four-necked flask equipped with a stirrer, thermometer, condenser and nitrogen gas-introducing pipe, into which was introduced nitrogen gas to replace the air thereinside, spending about 30 minutes, and after that, 3.0 g of 2,2'-azobis-isobutylonitrile were added to the content, which was then heated to 80° C. After heating at the temperature with stirring under the nitrogen gas flow for a period of four hours, 2.0 g of 2,2'-azobis-isobutylonitrile were further added and another four-hour reaction took place.

The reaction container was subsequently cooled to room temperature to thereby deposit a polymer, which was then filtered, washed with 200 ml of dichloroethane, and then dried at 50° C. under reduced pressure, whereby 84.4 g of a white powdery polymer were obtained. The average molecular weight of the thus obtained copolymer was 32800.

SYNTHESIS EXAMPLE 2

(Lactonization and esterification of the allyl acetate-maleic anhydride copolymer)

Into a 500 ml-three-necked flask equipped with a stirrer, thermometer and condenser was placed a mixture of 30 g of the allyl acetate-maleic anhydride copolymer obtained in Synthesis Example 1, 245 ml of n-butanol, 48 ml of water and 10.5 ml of concentrated sulfuric acid, and the mixture was stirred at 95° C. for 24 hours, and then cooled to room temperature and was allowed to stand for a whole day and night, after which a white polymer was deposited and the supernatant was removed in the decantation manner. The remaining polymer was dissolved into 180 ml of acetone, into which was poured 1.5 liters of water to thereby deposite the polymer, which was then filtered, washed sufficiently, and then dried at 55° C. under reduced pressure, whereby 18.1 g of a white powdery polymer were obtained. The polymer contained 1.22 milli equivalents of acid per 1 g thereof.

SYNTHESIS EXAMPLE 3

(Copolymerization of methallyl alcohol and maleic anhydride)

Into a 300 ml-four-necked flask equipped with a stirrer, thermometer, condenser and nitrogen gas flow-introducing pipe was placed a mixture of 100 ml of dioxane, 19.6 g of maleic anhydride (0.2 mol), 14.4 g of metharyl alcohol (0.2 mol), and 0.34 g of 2,2'-azobis-isobutylonitrile, and the mixture was polymerized for six hours with stirring at 60° C. under nitrogen gas flow. After completion of the reaction, the content was cooled to room temperature and then poured into 1 liter of methylene chloride. The deposited polymer was filtered, washed several times with 500 ml of methylene chloride, and then dried at 50° C. under reduced pressure, whereby 31.3 g of a white powdery polymer were obtained. The average molecular weight of the thus obtained copolymer was 45200.

SYNTHESIS EXAMPLE 4

(Lactonization and esterification of the methallyl alcohol-maleic anhydride copolymer)

A lactonization and esterification took place in n-butanol in the same manner as in Synthesis Example 2, thereby obtaining a white powdery lactone polymer. The polymer contained 1.05 milli equivalents of acid per gram thereof.

SYNTHESIS EXAMPLE 5

(Lactonization and esterification of the allyl acetate-maleic anhydride copolymer)

Into a 500 ml-three-necked flask equipped with a stirrer, thermometer, and condenser was placed a mixture of 30 g of the allyl acetate-maleic anhydride copolymer obtained in Synthesis Example 1, 185 ml of n-butanol, 185 ml of glycolic acid, 30 ml of water and 10.5 ml of concentrated sulfuric acid, and the mixture was stirred at 95° C. for 24 hours, after which a white polymer was deposited and then the supernatant was removed in the decantation manner. The remaining polymer was then dissolved into 300 ml of acetone, and the solution was poured into 3 liters of water to thereby deposite the polymer, which, after filtering, was washed sufficiently and then dried at 55° C. under reduced pressure, whereby 15.8 g of a white polymer were obtained. The polymer contained 2.05 milli equivalents of acid per gram thereof.

On the other hand, the method for the production of vinylidene chloride terpolymers having Formula (II) is described in detail in U.S. Pat. No. 2,943,937 and U.S. Pat. No. 2,627,088. Those lactone polymers consisting of those units having Formula (I) are excellent in the compatibility with, particularly, those vinylidene chloride terpolymers having Formula (II) and do not cause any devitrification, so that when used as a barrier layer, the layer is well light-transmissive, resulting in no decrease in the speed of a photographic element.

The temporary barrier layer of the present invention may be provided by coating and drying a solution prepared by dissolving into an organic solvent a mixture of a polymer consisting of monomers having Formula (I) and a polymer having Formula (II).

The mixing ratio of the above polymers, the lactone polymer to the vinylidene chloride terpolymer, is within the range of from 95:5 to 5:95.

When the polymer is a polymer latex obtained by the emulsion polymerization method, the polymer is desirable to be separated from the obtained latex, and then dissolved into an organic solvent. For the separation of the polymer from the latex, there may be used various methods, which include a method wherein a non-solvent for the polymer or a solvent that hardly dissolves the polymer is added to the latex to precipitate the polymer particles to thereby separate the polymer and another method wherein a water-soluble inorganic salt is added to the latex to precipitate the polymer particles to thereby separate the polymer, the former being more acceptable. As the solvent for precipitating the polymer particles, an alcohol solvent, particularly, methanol is suitably used.

The kind of the organic solvent to be used in dissolving the polymer may be changed according to the kind of the polymer used, but one that is capable of dissolving the polymer in a concentration of from 1% by weight to 10% by weight is desired to be used. The boiling point of the organic solvent to be used is desired to be from 50° C. to 150° C., and preferably from 50° C. to 95° C.

Typical examples of such organic solvents include aromatic hydrocarbons such as benzene, toluene, xylene; ketones such as acetone, methyl-ethyl ketone, isobutyl-methyl ketone, diethyl ketone, isoamyl-methyl ketone, dipropyl ketone, ethyl-propyl ketone; heterocyclic compounds such as dioxane, pyridine; cyclic compounds such as cyclohexane; aliphatic acids such as formic acid, acetic acid, and alkyl esters (such as ethyl acetate, butyl acetate) and acid anhydrides of these acids; aliphatic hydrocarbons such as petroleum ether, ligroin; alcohols such as methanol, ethanol, amyl alcohol, isopropyl alcohol; and halogenated hydrocarbons such as dichloromethane, 1,2-dichloroethane. These organic solvents may be used singly or in combination. Among these solvents, those preferred are ketones and aliphatic esters, and those particularly preferred among these ketones are methyl-ethyl ketone and acetone, and a concrete example of the use thereof in combination is methyl-ethyl ketone-n-propanol (mixing ratio of 6:4). In the dissolution, these solvents may, if necessary, be heated with stirring.

The polymer is desirable to be dissolved for coating into an organic solvent in a concentration of from 1 to 10% by weight, and preferably from 1 to 4% by weight.

In the present invention, for coating the organic solvent solution of the polymer, there may be used various conventionally known coating methods such as the dipping coating, roller coating, air-knife coating, slide hopper coating, curtain coating, and the like. And for the drying after the coating, there may be used such methods as the method which uses electromagnetic wave, e.g., infrared rays or ultrasonic wave, the method which uses a hot air, the method which uses a heating drum, and the like. The drying temperature may be variously changed according to the organic solvent used, the polymer used, and the like, but is normally from 40° to 100° C. The drying time may be variously changed depending on the kind of the solvent used at the time of coating and on the drying temperature applied, but is normally from 30 seconds to 4 minutes.

To the temporary barrier layer, particularly to the timing layer of the present invention, various additives may at need be added, which additives include surfactants, matting agents (such as powdery silica, polymer beads), filling agents (such as diatom earth, titanium dioxide, carbon black, colloidal silica), plasticizers (e.g., phosphates such as tricresyl phosphate, trialkyl phosphate; phthalates such as dihexyl phthalate, dibutyl phthalate), and the like, and preferred adding quantities of these additives are: from 0.05 to 0.5% by weight for surfactants, and from 0.1 to 20% by weight for the other additives per weight of the polymer.

Further, those additives to be added to the timing layer include a competitive developer such as the competitive developer precursor as described in Japanes Patent O.P.I. Publication No. 74744/1979 and a development inhibitor such as the development inhibitor precursor as described in Japanese Patent O.P.I. Publication No. 28823/1975.

The use of the temporary barrier layer of the present invention enables the separation of various reactants from each other, the reactants including, e.g., an acid and base, a developing agent and development inhibitor, a bleaching agent and metallic silver, and a silver halide and silver halide solvent, and the like.

The temporary barrier layer of the present invention, in various photographic element, is used between the two alkali-permeable layers thereof, thereby enabling to control the initiation of the actions of various reagents such as a development inhibitor.

The temporary barrier layer of the present invention is particularly useful when used as a timing layer in a color diffusion transfer photographic element that has on the support thereof as essential layers in order a neutralizing layer and the timing layer.

The thickness of the timing layer may be changed according to the compositions of the neutralizing layer and the processing chemicals to be incorporated, but is normally from 0.2$\mu$ to 15$\mu$, and preferably from 0.2$\mu$ to 10$\mu$.

The dependence of the foregoing alkali permeability upon temperatures is expressed by the activation energy of the permeation by the alkaline aqueous solution of the temporary barrier layer, said activation energy being determined by the following test: a photographic element having a transparent support coated in order thereon with:

(1) a neutralizing layer with the thickness of 22$\mu$ after drying having an acrylic acid-n-butyl acrylate copolymer (average molecular weight of 70,000, percent by weight ratio of 75:25) (220 mg/100 cm$^2$) and (2) a temporary barrier layer of the present invention having the polymer in the coating amount of 10 to 30 mg/100 cm$^2$, was prepared.

A transparent support is superposed upon the thus prepared photographic element and the following processing composition is then spread out in the thickness of 90$\mu$ therebetween at a temperature of 15° and 25° C.

| Composition: | |
|---|---|
| Sodium hydroxide | 45 g |
| Carboxymethyl cellulose sodium salt | 25 g |
| Thymolphthalein | 1 g |
| Distilled water to make | 1 liter |

After the composition is spread, the time required until the pH indicator thymolphthalein begins to become colorless and the time required for the indicator to be completely colorless are measured, and the average of these times is regarded as the time for the color change, and the activation energy may be determined according to the following Arrhenius's formula:

$$Ea \text{ (activation energy)} = 0.00458 \times \frac{\log Y_2/Y_1}{1/T_2 - 1/T_1}$$

wherein $T_2$ is the higher temperature; $T_1$ is the lower temperature; $Y_2$ is the time (min.) for the color change at $T_2$; and $Y_1$ is the time (min.) for the color change at $T_1$.

The time for the color change represents the time required for the hydrogen ion concentration (pH) to become about 10 (normally called "neutralizing time"), which serves as a reference to the permeable time of the foregoing alkaline aqueous solution. And the pH 10 is the environment in which, in the photographic chemistry, the action of a silver halide emulsion is substantially stopped.

For the support of the photographic element of the present invention, any support for those conventionally known photographic materials, whether transparent or opaque, may be used according to purposes.

Any neutralizing layer is acceptable for the present invention if it is capable of lowering the pH of the image-receiving layer in the system after the substantial formation of a transferred image, and for this purpose those various conventionally known (for example, a polymer acid layer) may be used. The neutralizing layer stops the development after the substantial image formation and prevents the subsequent transfer of the excessive diffusible dye, and further increases the stability of the transferred image.

The timing layer of the present invention may have thereon an alkali-transmissable, hydrophilic layer.

The applicable alkali-transmissible, hydrophilic layer includes, e.g., gelatin, polyvinyl alcohol, ethyl methacrylate-methacrylic acid copolymer, methyl methacrylate-methacrylic acid copolymer, methyl-vinyl ether-maleic anhydride copolymer, casein, carboxymethyl cellulose, cellulose acetate phthalate, hydroxyethyl cellulose. Particularly preferred one among them is gelatin. These alkali-transmissible, hydrophilic layers may, if necessary, be hardened or bridge-structured.

The photographic element of the present invention may, at need, be provided with an adhesion-accelerating layer directly on or through the foregoing alkali-transmissible, hydrophilic layer on the timing layer of the present invention.

The adhesion-accelerating layer is effectively used in the photographic element for the adhesion of the spacer rail that serves to regulate the thickness of the alkaline processing composition.

As the adhesion-accelerating layer an alkali-transmissible layer is desirable, which include, for example, a substantially not integrative acrylonitrile-vinylidene chloride-acrylic acid copolymer.

The photographic element of the present invention includes various embodiments in which the temporary barrier layer of the present invention is employed (as described in, e.g., Japanese Patent Application No. 227/1980) and which include one that is sensitive to light and one that is insensitive to light. A particularly preferred embodiment is such a color diffusion transfer photographic material as having between the two transparent supports thereof as essential layers in order an image-receiving layer, light-reflective layer, opaque layer, cyan color image forming material layer, red-sensitive silver halide emulsion layer, interlayer magenta color image forming material layer, green-sensitive silver halide emulsion layer, interlayer, yellow color image forming material layer, blue-sensitive silver halide emulsion layer, protective layer, timing layer and neutralizing layer. The color image forming materials used in the above may be either non-diffusible or diffusible in an alkaline medium, and conventionally known various color forming materials may be used.

Those non-diffusible color image forming materials in an alkaline medium include the so-called dye-releasable type redox compounds as described in, e.g., U.S. Pat. No. 4,076,529 and No. 3,443,939, French Pat. No. 2,284,140, and Japanese Patent O.P.I. Publications No. 46730/1978, No. 50736/1978, No. 113624/1976, No. 3819/1978 and No. 54021/1979; non-diffusible color image forming materials capable of releasing diffusible dyes in an alkaline medium but, when reacting in advance with the oxidized product of a silver halide developing agent, the releasing rate thereof becomes lowered as described in, e.g., Japanese Patent O.P.I. Publications No. 111628/1974 and No. 63618/1976; the so-called BEND compounds as described in, e.g., Japanese Patent O.P.I. Publications No. 110827/1978 and No. 110828/1978; and the so-called diffusible dye releasable type couplers as described in, e.g., U.S. Pat. No. 3,227,550.

Those substantially diffusible color image forming materials in an alkaline medium include the so-called dye developing agents as described in e.g., U.S. Pat. No. 2,983,606, U.S. Pat. No. 3,880,658, U.S. Pat. No. 3,854,945 and U.S. Pat. No. 3,563,739.

Those color image forming materials particularly effective in the present invention are dye-releasable type redox compounds.

Preferred ones among such dye-releasable type redox compounds are non-diffusible sulfonamide type dye-releasable redox compounds which are capable of releasing sulfamoyl group-having diffusible dyes or the recursors thereof. Particularly preferred ones among them are those having the formula (IV), (V) or (VI):

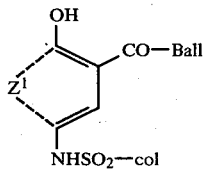

Formula (IV)

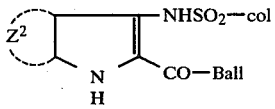

Formula (V)

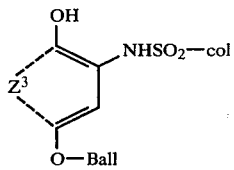

Formula (VI)

wherein Ball is an organic ballasting group having such number of carbon atoms as to enable the compound to be non-diffusible while being processed with an alkaline processing composition, $Z^1$ is a group of carbon atoms necessary to complete benzene ring or naphthalene ring, $Z^2$ and $Z^3$ each is a group of carbon atoms necessary to complete a benzene ring, but the benzene ring and the naphthalene ring may have one or more substituents, and col is a dye or the precursor thereof.

For the light-sensitive silver halide emulsion layer used in combination with a color image forming material, conventionally known various kinds of emulsion may, if desired, be used, which may be of either negative type of positive type.

The processing composition for use in the processing of the foregoing color diffusion transfer photographic material is normally an alkaline processing composition containing alkali agents, whose pH is not less than 10 at room temperature.

The processing composition is desirable to contain a viscous agent having normally a viscosity of from 100 to 300,000 centipoise, which enables the uniform distribution of the processing composition during processing, and which further forms a nonfluid membrane during processing to prevent the undesirable change in the image after the dye image formation.

If the color image forming material itself has no function of developing any silver halide, a silver halide developing agent is used, which includes, e.g., 3-pyrazolidone compounds such as 1-p-methyl-phenyl-4-hydroxymethyl-4-methyl-3-pyrazolidone, 1-phenyl-4-hydroxymethyl-4-methyl-3-pyrazolidone.

Even in the case where the color image forming material itself has a silver halide developing action, the auxiliary use of a silver halide developing agent is desired. The silver halide developing agent is normally incorporated into the processing composition and/or the processing composition-permeable layer in the photographic element. In addition, the processing composition may contain a silver halide solvent and the like depending on the silver halide emulsion used, or may, if necessary, contain any commonly usable various additives such as a light-reflective agent (e.g., titanium dioxide), an opacifying agent (e.g., carbon black, indicator dyes), and the like.

For the application of the processing composition to a color diffusion transfer photographic element, any various means conventionally known may be used, but it is desired that the processing composition is contained in a container which is rupturable at the time of processing.

The excellence of the photographic element of the present invention is illustrated in further detail with reference to examples below, but the present invention is not limited thereto.

EXAMPLE 1

A transparent 100μ-thick polyethylene terephthalate support was coated thereon with an acrylic acid-n-butyl acrylate copolymer (% by weight ratio of 75:25) as a first layer in the coating amount of 220 mg/100 $cm^2$. On this was then coated a timing layer in the coating amount of 22 mg/100 $cm^2$, the timing layer being prepared by mixing in various proportions the following lactone polymer and terpolymer, thereby preparing processing sheets (1) to (8). For comparison, control processing sheets (1) to (4) containing no lactone polymer were prepared. These control processing sheets each was coated with a timing layer in the coating amount of 5 mg/100 $cm^2$. The coating of the timing layer was made by the use of a methyl-ethyl ketone solution.

Lactone polymer, Exemplified Compound (2) (acid content 1.22 milli equivalent/g)

Lactone polymer, Exemplified Compound (4) (acid content 1.05 milli equivalent/g)

Vinylidene chloride terpolymer, Exemplified Compound (5)

Vinylidene chloride terpolymer, Exemplified Compound (7)

Vinylidene chloride terpolymer (A): Vinylidene chloride-ethyl acrylate-itaconic acid (weight ratio of 65:30:5)

Vinylidene chloride terpolymer (B): Vinylidene chloride-acrylonitrile-methacryloyloxyethyl phosphate (weight ratio of 80:12:8)

In order to examine the effects by the above barrier layers of the respective processing sheets, each processing sheet, a 100μ-thick transparent polyethylene terephthalate sheet and the foregoing 1 ml alkaline composition-containing rupturable pod were used to prepare a test unit, which was then tested according to the foregoing test method, thereby determining the time for the color change (neutralizing time (min.)) and the activation energy (Ea) of each sample. The results are shown in Table 1. On the other hand, in order to examine the stability in storage of each processing sheet, each of the sheets was allowed to stand over a period of full three days under the atmospheric conditions at temperatures of 55° C. and, 50° C. and relative humidity of 80%. These processing sheets before and after being subjected to the above accelerated aging conditions were processed in the same manner as previously mentioned to determine the changing degrees of the neutralizing time and the activation energy:

$$\text{Changing degree (\%)} = \frac{\text{Value after aging} - \text{Value before aging}}{\text{Value before aging}} \times 100$$

The changing degrees at 25° C. are shown in Table 1.

TABLE 1

| Processing sheet | Lactose polymer | Vinylidene chloride terpolymer | Proportion of terpolymer/lactone polymer | Neutralizing time (min) 15° C. | 25° C. | 35° C. | Ea (Kcal/mol) | Changing degree (%) after 3-day aging at 55° C. Neutralizing time | Ea | Changing degree (%) after 3-day aging at 50° C., 80% RH Neutralizing time | Ea |
|---|---|---|---|---|---|---|---|---|---|---|---|
| Processing sheet (1) | Exemplified Compound (2) | Exemplified compound (5) | 80/20 | 18.7 | 4.2 | 1.3 | 25.5 | +12.5 | +5.2 | −5.3 | +1.3 |
| Processing sheet (2) | Exemplified Compound (2) | Exemplified compound (5) | 60/40 | 12.5 | 3.5 | 0.8 | 21.8 | +10.3 | +4.2 | −4.2 | −2.0 |
| Processing sheet (3) | Exemplified compound (4) | Exemplified compound (5) | 60/40 | 13.8 | 3.7 | 1.0 | 22.6 | +9.6 | +2.5 | −5.8 | −2.5 |
| Processing sheet (4) | Exemplified compound (2) | Exemplified compound (7) | 60/40 | 23.2 | 5.0 | 1.6 | 26.3 | +14.5 | +6.3 | −6.2 | −1.2 |
| Processing sheet (5) | Exemplified compound (4) | Exemplified compound (7) | 70/30 | 28.9 | 5.7 | 1.8 | 27.8 | +16.2 | +5.7 | −2.6 | −3.4 |
| Processing sheet (6) | Exemplified compound (2) | (A) | 50/50 | 7.5 | 2.0 | 0.7 | 22.4 | +8.3 | +2.0 | −1.8 | −0.8 |
| Processing sheet (7) | Exemplified compound (4) | (A) | 60/40 | 17.6 | 4.0 | 1.2 | 25.4 | +13.4 | +5.3 | −4.8 | +1.5 |
| Processing sheet (8) | Exemplified compound (2) | (B) | 60/40 | 18.3 | 5.8 | 2.0 | 19.7 | +19.8 | +7.6 | −10.3 | −4.8 |
| Control processing sheet (1) | — | Exemplified compound (5) | 100/0 | 13.5 | 5.1 | 2.2 | 16.7 | +50.1 | −29.3 | +20.8 | −26.5 |
| Control processing sheet (2) | — | Exemplified compound (7) | 100/0 | 25.8 | 12.3 | 5.2 | 12.7 | +42.5 | −32.2 | +35.4 | −30.6 |
| Control processing sheet (3) | — | (A) | 100/0 | 18.2 | 8.5 | 4.3 | 13.1 | +38.6 | −25.5 | +25.9 | −22.1 |
| Control processing sheet (4) | — | (B) | 100/0 | 15.8 | 6.3 | 3.1 | 15.8 | +56.5 | −53.6 | +96.5 | −43.2 |

Table 1 shows that the changing degrees after the aging in the neutralizing time and the activation energy of the processing sheets of the present invention are significantly smaller than those of the control processing sheets.

EXAMPLE 2

The processing sheets (1) to (8) and the control processing sheets (1) to (4) in Example 1 were used to measure the whole alkali-neutralizing process thereby to determine the sharpness (S) of the reduction of the pH.

In order to measure the whole process of alkali neutralization, the following manner took place:

A planar composite electrode was used as a pH electrode. The following alkaline composition was spread in the amount of 10 μl/cm² between the processing sheet and the pH electrode. The pH electrode was connected to a recorder to thereby measure the whole process of the alkali neutralization.

| Alkaline composition: | |
|---|---|
| Potassium hydroxide | 56 g |
| Carboxymethyl cellulose sodium salt | 10 g |
| Distilled water to make | 1 liter |

As a measure (sharpness) for the reduction of the pH, the following formula was used. The results are shown in Table 2. The measurements were made at 25° C.

$$S\ (\text{sharpness}) = \frac{\text{Time (min) required for pH to become 10}}{\text{Time (min) required to retain pH 14}}$$

TABLE 2

| Processing sheet No. | S (sharpness) |
|---|---|
| Processing sheet (1) | 1.31 |
| Processing sheet (2) | 1.25 |
| Processing sheet (3) | 1.23 |
| Processing sheet (4) | 1.23 |
| Processing sheet (5) | 1.27 |
| Processing sheet (6) | 1.29 |
| Processing sheet (7) | 1.20 |
| Processing sheet (8) | 1.35 |
| Control processing sheet (1) | 2.86 |
| Control processing sheet (2) | 3.03 |
| Control processing sheet (3) | 2.56 |
| Control processing sheet (4) | 3.42 |

As apparent from Table 2, the pHs of the processing sheets of the present invention reduction more sharply than those of the control processing sheets.

EXAMPLE 3

A transparent 100μ-thick polyethylene terephthalate support was coated thereon with an acrylic acid-n-butyl acrylate copolymer (weight ratio of 75:25) as a first layer in the coating amount of 220 mg/100 cm$^2$, on which was then further coated a timing layer in the coating amount of 22 mg/100 cm$^2$. As the timing layer the lactone polymers, Exemplified Compound (2), Exemplified Compound (4) and terpolymer, Exemplified Compound (5) in Example 1 were used to prepare processing sheets (II-1) to (II-4). Each of the timing layers was coated in the form of a methyl-ethyl ketone solution.

For comparison, control processing sheets (II-1) and (II-2) were prepared in the same manner as in the above, using the lactone polymer as described in Japanese Patent O.P.I. Publication No. 54341/1980, said lactone polymer (lactone polymer (A)) having the formula:

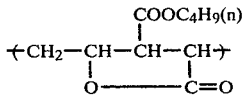

The turbidities of these processing sheets of the present invention and control processing sheets were measured by means of an integral sphere type turbidimeter (SEP-RT-201, manufactured by Nippon Seimitsu Kogaku, K.K.). The obtained results are shown in Table 3.

TABLE 3

| Processing sheet No. | Lactone polymer | Vinylidene chloride terpolymer | Proportion of terpolymer/ lactone polymer | Turbidity (PPM) |
|---|---|---|---|---|
| Processing sheet (II-1) | Exemplified compound (2) | Exemplified compound (5) | 80/20 | 2.5 |
| Processing sheet (II-2) | Exemplified compound (2) | Exemplified compound (5) | 60/40 | 3.6 |
| Processing sheet (II-3) | Exemplified compound (4) | Exemplified compound (5) | 80/20 | 3.2 |
| Processing sheet (II-4) | Exemplified compound (4) | Exemplified compound (5) | 60/40 | 4.0 |
| Control processing sheet (II-1) | (A) | Exemplified compound (5) | 80/20 | 36 |
| Control processing sheet (II-2) | (A) | Exemplified compound (5) | 60/40 | 65 |

As apparent from Table 3, in the processing sheets containing the mixtures of the polymers of the present invention, the turbidities thereof are so small that satisfactorily transparent layers are obtained, whereas the control processing sheets have fairly large turbidities, so that the transparency of the layers thereof are deteriorated.

EXAMPLE 4

Processing sheets (III-1) to (III-4) and control processing sheets (III-1) and (III-2) were prepared in the same manner as in Example 3 with the exception that 5-(2-cyanoethyl-thio)-1-phenyl-tetrazole (1.0 mg/100 cm$^2$) and 2-t-butyl-4-acetyloxyphenol (2.0 mg/100 cm$^2$) were added to the timing layers of the processing sheets (II-1) to (II-4) and of the control processing sheets (II-1) and (II-2) in Example 3.

On the other hand, a 100μ-thick transparent polyethylene terephthalate support was coated in order thereon with the following layers to thereby prepare a multicolor light-sensitive element:

(1) Image-receiving layer:

an image-receiving layer having acid-treated gelatin (22 mg/100 cm$^2$) and copoly(styrene-co-vinyl-benzyl-N-benzyl-N,N-dimethyl-ammonium chloride-co-divinyl benzene) (molar ratio of 49:49:2) (22 mg/100 cm$^2$), (2) Light-reflective layer:

a light-reflective layer having titanium dioxide (220 mg/100 cm$^2$) and gelatin (22 mg/100 cm$^2$), (3) Opaque layer:

an opaque layer having carbon black (27 mg/100 cm$^2$) and gelatin (17 mg/100 cm$^2$), (4) Cyan color image forming material layer:

a cyan color image forming material layer having a cyan color image forming material (3.2 mg/100 cm$^2$), diethyl lauramide (1.6 mg/100 cm$^2$) and gelatin (11 mg/100 cm$^2$), said cyan color image forming material having the formula:

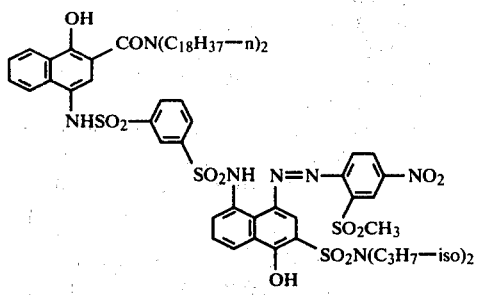

(5) Red-sensitive internal latent image type direct positive silver bromide emulsion layer:

a red-sensitive silver bromide emulsion layer having a red-sensitive internal latent image type direct positive silver bromide emulsion (silver equivalent of 9 mg/100 $cm^2$, gelatin: 9 mg/100 $cm^2$), potassium-2-octadecyl hydroquinone-5-sulfonate (16 g per mol of silver) and a fogging agent 1-acetyl-2-{4-[5-amino-2-(2,4-di-t-pentyl-phenoxy)benzamide]phenyl}hydrazine 85 mg per mol of silver) and 1-p-formyl-hydrazinophenyl-3-phenyl-2-thiourea (3.5 mg per mol of silver), (6) Interlayer:

a layer having gelatin (16 mg/100 $cm^2$) and 2,5-di-sec-dodecyl hydroquinone (13 mg/100 $cm^2$), (7) Magenta color image forming material layer:

a magenta color image forming material layer having a magenta color image forming material (3.2 mg/100 $cm^2$), diethyl lauramide (1.6 mg/100 $cm^2$) and gelatin (12 mg/100 $cm^2$), said magenta color image forming material having the formula:

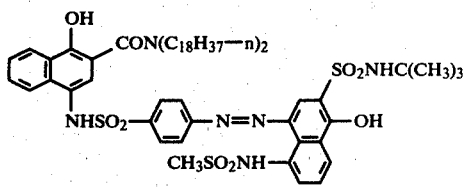

(8) Green-sensitive internal latent image type direct positive silver bromide emulsion layer:

a green-sensitive emulsion layer having a green-sensitive internal image type direct positive silver bromide emulsion (silver equivalent of 9 mg/100 $cm^2$, gelatin: 9 mg/100 $cm^2$), potassium-2-octadecyl-hydroquinone-5-sulfonate (16 g per mol of silver) and a fogging agent 1-acetyl-2{4-[5-amino-2-(2,4-di-t-pentyl-phenoxy)benzamide]phenyl}hydrazine (70 mg per mol of silver) and 1-p-formyl-hydrazinophenyl-3-phenyl-2-thiourea (2.5 mg per mol of silver), (9) Interlayer:

an interlayer having gelatin (16 mg/100 $cm^2$) and 2,5-di-sec-dodecyl hydroquinone (13 mg/100 $cm^2$),

(10) Yellow color image forming material layer:

an yellow color image forming material layer having an yellow color image forming material (4.3 mg/100 $cm^2$), diethyl lauramide (2.2 mg/100 $cm^2$) and gelatin (15 mg/100 $cm^2$), said yellow color image forming material having the formula:

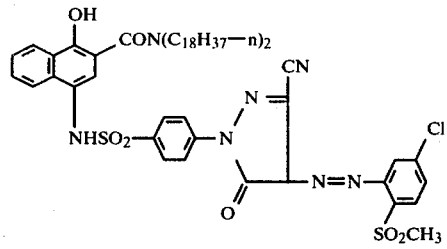

(11) Blue-sensitive internal latent image type direct positive silver bromide emulsion layer:

a green-sensitive emulsion layer having a blue-sensitive internal latent image type direct positive silver bromide emulsion (silver equivalent of 9 mg/100 $cm^2$, gelatin: 9 mg/100 $cm^2$), potassium 5-sec-octadecyl-5-hydroquinone-2-sulfonate (16 mg per mol of silver) and a fogging agent 1-acetyl-2-{4-[5-amino-2-(2,4-di-t-pentyl-phenoxy)benzamide]phenyl}hydrazine (80 mg per mol of silver) and 1-formyl-hydrazinophenyl-3-phenyl-2-thiourea (3.3 mg per mol of silver), and

(12) Protective layer:

a protective layer having gelatin (10 mg/100 $cm^2$).

The thus prepared multicolor light-sensitive element was superposed on each of the foregoing processing sheets (III-1) to (III-4) and control processing sheets (III-1) and (III-2), and each superposed unit was subjected to a given exposure through a silver 30-step optical wedge with each step differential in density of 0.15. Each of the exposed multicolor light-sensitive elements was superposed with processing sheet (III-2), and a pod containing 1 ml of the following processing composition was attached to therebetween, thereby preparing film units (III-1) to (III-4) and control film units (III-1) and (III-2). On the other hand, as control, a 100$\mu$-thick polyethylene terephthalate film was used to prepare superposed and exposed film units in the same manner as in above.

Each of the film units was subsequently passed between a pair of juxtaposed pressure rollers at 25° C. to thereby spread the processing composition in the thickness of 70$\mu$ between the processing sheet and the multicolor light-sensitive element.

The processing composition used herein is as follows:

| | |
|---|---|
| Potassium hydroxide | 47.0 g |
| Sodium sulfite | 1.0 g |
| 1-phenyl-4-hydroxymethyl-4-methyl-3-pyrazolidone | 12.0 g |
| 5-methyl-benzotriazole | 3.8 g |
| Carboxy-methyl-cellulose sodium salt | 44.0 g |
| Carbon black | 172.0 g |
| t-butyl hydroquinone | 0.3 g |
| Potassium fluoride | 10.0 g |
| Distilled water to make | 1 liter |

Several minutes later, a dye image was observed through the transparent support of the multicolor light-sensitive element. The reflection density of the obtained dye image was measured by the use of a SAKURA Photoelectric densitometer Model PAD-60 (manufactured by Konishiroku Photo Industry Co., Ltd.) with each of red ($\lambda max = 644$ nm), green ($\lambda max = 546$ nm) and blue ($\lambda max = 434$ nm) filters.

The changes in the respective sensitivities of the obtained sensitometric charateristics are shown in Table 4. As for the sensitivity, the sensitivity at the point of the minimum density plus 0.5 was used. As to the change in the sensitivity, the value obtained by substracting the sensitivity of the control film unit from each of the sensitivities of the respective film units (i.e., the difference in sensitivity) was used.

TABLE 4

| Film unit No. | Difference in sensitivity | | |
|---|---|---|---|
| | Blue | Green | Red |
| Film unit (III-1) | −0.02 | 0.00 | 0.00 |
| Film unit (III-2) | −0.01 | −0.01 | 0.00 |
| Film unit (III-3) | −0.01 | 0.00 | 0.00 |
| Film unit (III-4) | −0.02 | −0.02 | −0.01 |
| Control film unit (III-1) | −0.05 | −0.04 | −0.04 |
| Control film unit (III-2) | −0.08 | −0.06 | −0.07 |

As apparent from Table 4, the processing sheets of the present invention which are excellent in transparency show very small degrees of deterioration of the sensitivities thereof as compared to the control processing sheets whose transparency is unsatisfactory.

What is claimed is:

1. A photographic element comprising a support having thereof at least one silver halide emulsion layer and at least one temporary barrier layer, said temporary barrier layer comprising a mixture of a lactone polymer with repetitive units represented by the formula (I);

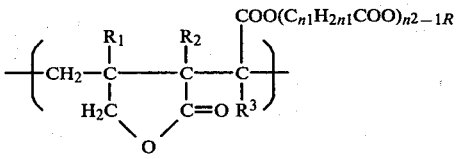

Formula (I)

and a vinylidene chloride terpolymer represented by the formula (II);

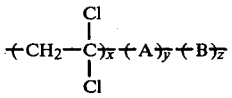

Formula (II)

wherein R is a hydrogen atom, an alkyl or an aralkyl group; $R^1$, $R^2$ and $R^3$ each is a hydrogen atom or a methyl group; $n^1$ is an integer of from 1 to 5, while $n^2$ is an integer of 1 or 2; A is a monomer unit of a copolymerizable ethylenically unsaturated acid or of the salt thereof, while B is a copolymerizable ethylenically unsaturated monomer unit; x represents from 50 to 99.5% by weight, y represents from 0.5 to 44.5% by weight, and z represents from 0 to 49.5% by weight.

2. A photographic element according to claim 1, wherein A in the formula (II) is a monomer unit of a copolymerizable ethylenically unsaturated acid or salt thereof having at least one carboxyl, sulfo, or phosphono group.

3. A photographic element according to claim 1, wherein A in the formula (II) is selected from the group consisting of acrylic acid, methacrylic acid, itaconic acid, monomethyl itaconate, monobutyl itaconate, monomethyl maleate, monobutyl maleate, styrene sulfonate, acryloyloxypropyl sulfonate, 2-acrylamide-2-methyl-ethane sulfonate and alkali metal salt or ammonium salts thereof.

4. A photographic element according to claim 1, wherein B in the formula (II) is selected from the group consisting of ethylenically unsaturated nitriles, styrenes, ethylenically unsaturated acid esters, ethylenically unsaturated acid amides, and vinyl heterocyclic compounds.

5. A photographic element according to claim 1 wherein in the formula (II) x represents from 50 to 90% by weight, y represents from 0.5 to 20% by weight, and z represents from 0 to 49.5% by weight.

6. A photographic element according to claim 1, wherein the temporary barrier layer comprises a mixture of (1) from 5 to 95% by weight of the lactone polymer and (2) from 95 to 5% by weight of the vinylidene chloride terpolymer.

7. A photographic element according to claim 1, wherein the element further comprises a neutralizing layer.

8. A photographic element according to claim 1, wherein the element comprises two transparent supports and, between the supports, an image-receiving layer, a light-reflective layer, an opaque layer, a cyan color image forming material containing layer, a red-sensitive silver halide emulsion layer, an interlayer, a magenta color image forming material containing layer, a green-sensitive silver halide emulsion layer, an interlayer, a yellow color image forming material containing layer, a blue-sensitive silver halide emulsion layer, a protective layer, a timing layer and a neutralizing layer in this order.

* * * * *